US006066347A

United States Patent [19]

Prasad et al.

[11] Patent Number: 6,066,347

[45] Date of Patent: May 23, 2000

[54] AROMATIZED FOOD PACKAGE

[75] Inventors: Nikhil Prasad, New Milford; Jeffrey Willey, Brookfield, both of Conn.

[73] Assignee: Nestec S.A., Vevey, Switzerland

[21] Appl. No.: 09/200,156

[22] Filed: Nov. 25, 1998

[51] Int. Cl.[7] ..... B65B 25/22

[52] U.S. Cl. ..... 426/107; 426/113; 426/415

[58] Field of Search ..... 426/107, 113, 426/112, 124, 234, 412, 415; 206/205; 523/160

[56] References Cited

U.S. PATENT DOCUMENTS

| | | | |
|---|---|---|---|
| 4,034,116 | 7/1977 | Hamell et al. | 426/131 |
| 4,834,247 | 5/1989 | Oshima et al. | 206/631 |
| 4,857,340 | 8/1989 | Parliment et al. | 426/96 |
| 4,933,193 | 6/1990 | Fisher | 426/107 |
| 4,990,345 | 2/1991 | Webb | 426/123 |
| 5,053,236 | 10/1991 | Parliment et al. | 426/234 |
| 5,374,457 | 12/1994 | Juhl et al. | 428/34.8 |
| 5,498,452 | 3/1996 | Powers | 428/34.2 |
| 5,523,335 | 6/1996 | Whyzmuzis et al. | 523/160 |
| 5,688,545 | 11/1997 | Sanders | 426/120 |

FOREIGN PATENT DOCUMENTS

| | | |
|---|---|---|
| 0 287 323 | 10/1988 | European Pat. Off. . |
| 0 320 294 | 6/1989 | European Pat. Off. . |
| 0 706 944 B1 | 8/1996 | European Pat. Off. . |
| WO 97/36798 | 10/1997 | WIPO . |

*Primary Examiner*—Milton Cano
*Assistant Examiner*—Sherry A. Dauerman
*Attorney, Agent, or Firm*—Pennie & Edmonds LLP

[57] ABSTRACT

A food package having a built-in aroma. The package includes a food compartment and an aromatized substrate comprising a heat sensitive sealant which captures the aroma. The aromatized substrate is effective to preserve the aroma during freezing, refrigeration, and ambient storage, and is capable of releasing the aroma when the package with the food in the food compartment is heated in a microwave oven.

20 Claims, 2 Drawing Sheets

AROMATIZED FOOD PACKAGE

FIELD OF INVENTION

The present invention relates to aromatizing of a food product. More particularly, it relates to a food package with in-build aroma.

BACKGROUND OF INVENTION

In some cases it is desirable to aromatize a food package in order to increase the smell of freshness and to stress the uniqueness of the food product so that the consumer's appetite will be whetted on smelling the aroma or fragrance. In some cases it is desirable to aromatize headspace of a food package, so that, on opening the package, the consumer will smell the aroma.

A system for aromatizing a headspace of a food package is disclosed in European patent 0 706 944. For an injection into a headspace of a food package of aroma dissolved in a liquid gas, the liquid gas and aroma must be dispensed e.g. by means of a spraying nozzle as described in the above-cited patent or by means of a dispenser for aroma gas.

Another system for aromatizing a headspace of a food package is disclosed in U.S. Pat. No. 5,885,640. In this system, a noble or inert gas such as Argon may be aromatized and used for introducing an aroma into the headspace of a food package to impart a desirable aroma and increase the smell of freshness on opening the package. The system allows for a direct mixing of the aromatized inert gas with gases used for modifying atmosphere such as carbon dioxide or nitrogen or mixtures thereof. The mixing can be done with a gas mixer in a pre-selected proportion. The mixed aromatized food-acceptable inert gas and the modified atmosphere is then injected into food packages using commercially available gas packing machines. The aroma used is soluble or mixable in gaseous food-acceptable inert gas.

Although the above-discussed systems provide many advantages, for certain types of food products the coexistence with certain types of aroma is less appropriate. In such instances there may be a risk that the food product absorb the aroma in a few days and almost no aroma will be represented in the headspace. A reason for this is that the aroma may interact with the food matrix and develop off-flavors, undergo oxidation or be absorbed by the matrix.

This is a problem that occurs when a product is stored refrigerated or is kept frozen for an extended period of time. Freezing the above types of aroma with the product results in complex food-matrix interactions that reduce the aroma in the package.

Furthermore, the heating of the above described food packages generally cannot be done without influencing the aroma generation due to the interaction of the heated aroma and heated food product.

European patent application 97/201578.8 provides an alternative to the above. It concerns a food package comprising a first cavity with a food product and a second cavity with food-acceptable aroma. The first and second cavity being separately sealed by a cover which when removed opens both cavities.

SUMMARY OF THE INVENTION

The present invention provides a further alternative to the above-discussed way of giving the consumer the experience of freshness and uniqueness of the food product without the aroma being in the headspace of the food package.

The present invention relates to a food package with in-built aroma comprising a food compartment and an aromatized substrate comprising a heat sensitive sealant which captures the aroma, the aromatized substrate is effective to preserve the aroma during freezing, refrigeration, and ambient storage, and capable of releasing the aroma when the food in the food compartment is heated in a microwave oven. The package according to the invention allows aroma to be released during the heating of the product in the package.

The aroma need not be in direct contact with the food problem, thus avoiding the problems indicated above. The aroma can be generated in a microwave oven. In general, heating of food products in microwave ovens has a reduced flavor generation when compared with heating of food in a conventional oven. Thus, the invention has been found to be particular useful for microwave prepared meals. By heating the frozen product in an at least partly opened container, the aroma from the food product is enhanced by the aroma of aromatized substrate. In a preferred embodiment of the invention the aromatized substrate comprises aroma, an aroma solvent and the sealant.

DETAILED DESCRIPTION OF THE INVENTION

Figure 1:
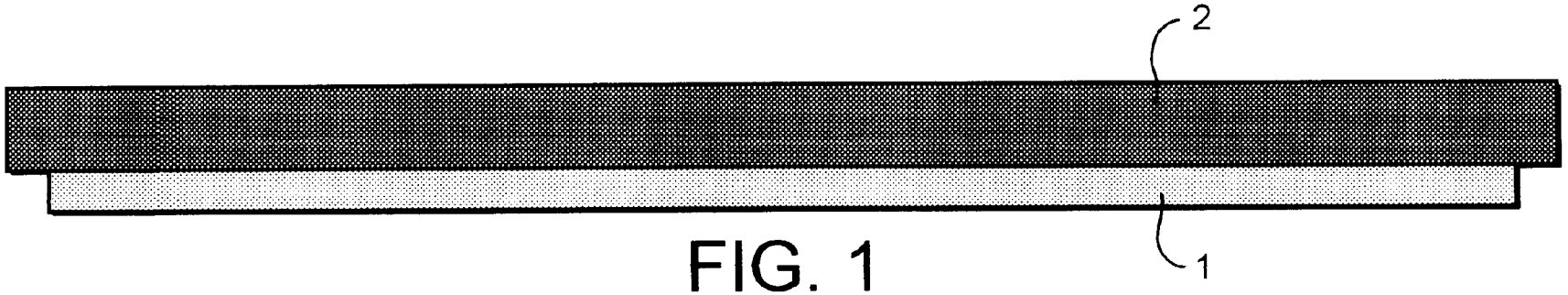
FIGS. 1–4 are side views, in cross section, of various aromatized substrates according to the invention.

Aroma is the volatile portion of a medium that can be perceived by the nasal passage. Food aroma can be derived from a botanical, animal or ocean source. For a meal the aroma is preferably selected from a group consisting of savory based flavors or aromatics (e.g. poultry, fish, meat, vegetables, spices, fermented dairy products). For desserts the aroma is preferably selected from sweet based flavors.

In the present context, a sealant is a substance added to a package component that allows one package component (such as lid stock or a label) to attach to another (such as a tray or lid-stock). The substance can typically be activated by the addition of heat, liquid or pressure, and may be fused or peelable. Sealant of the present invention is heat sensitive. A suitable sealant allows the aroma to be released at temperatures above ambient and at about 100° C. or below. It is preferred that the sealant does not release the aroma unless the temperature is elevated to above about 40° C. Sealants, which have shown to be useful, are amorphous polyethylene tetraphlate based (APET), Ethyl Vinyl Acetate based (EVA) or acrylic based pressure sensitive sealants. Most preferred is APET, a material that has been shown to provide a high degree of aroma intensity when the package is heated.

In the context of this invention, a solvent is a polar or non-polar substance added to an aroma as a delivery system or a diluent. Preferably, the solvent is selected from a group consisting of fixed oils (e.g. Soy-oil, Peanut oil, MCT oil) or Mono-, di- or tri-hydric molecules (e.g. Ethanol, propylene glycol or glycerin)or a combination thereof. Ethanol has been found to be the most preferred solvent giving a high degree of aroma intensity when the package is heated.

It has been found that the range of aroma incorporations in the final frozen food package with a substrate should be such a flavor load is between 15 and 100 ppm of active ingredient per frozen entrée to perceive aroma during microwave heating. A preferred flavor load is between 45 and 100 ppm of active ingredient per frozen entrée. To accomplish this coat weights and diluents/solvents may be varied.

The range of coat weights for film or label may vary from 7 mg/sq inch for a pressure sensitive label to 100 mg/sq inch for a lid-stock film. This is dependent on the combination of the type of flavor, the solvent, the sealant and the coating technique because the release behavior of the aroma compounds is effected by each of these variables.

Solvent may and may not be used, this depends on the aroma selected. Aroma that does not require a solvent may be coated directly, on the other hand it may be necessary to dilute form anywhere between 0–70% depending on the flavor.

Each flavor may require a different loading since they comprise of different aroma chemicals. Examples of preferred coat weights of the aromatized substrate are above 6.5 g/m2. More preferred, the coat weight of the aromatized substrate is above 7.0 g/m2. With these values a significant aroma impact is obtained.

The aroma and a solvent may be mixed and coated onto a packaging film. The sealant is coated onto the layer of aroma and solvent. Alternatively, the aroma, solvent and the sealant are mixed and coated onto the packaging film. The packaging film is used as part of the packaging material. For example, the substrate is coated onto a film which constitute the package lid. Alternatively, the aroma, solvent and the sealant may be coated directly onto the package itself. As a further alternative, the film with the substrate may be formed into labels. The aromatized substrate is then incorporated in or on the label, which is attachable to the package. If the aromatized substrate is in the form of a label, it may be printed onto the label utilizing flexographic printing techniques.

As discussed above, it may be desirable to avoid contact between the food product and the aromatized substrate. The aromatized substrate should in this case not be in or part of the food compartment inside surface. Advantageously, the aromatized substrate is attached to the outside face of the package. This will allow aroma to be generated without opening of the package.

The invention has been found to be particularly useful for aromatizing packages with frozen food. Tests have shown that the package has freeze-thaw stability. In a preferred embodiment of the invention the load level of aroma and solvent is from 5.0 to 8.0 g/m2 preferably from 5.3 to 7.5 g/m2. The solvent preferably is ethanol. Ethanol as solvent has a more effective aroma release during microwave cooking compared to MCT oil. This was found both in headspace analysis and technical screening.

EXAMPLES

The following examples are provided to illustrate the features of the preferred embodiments.

Example 1

Preparation of aromatized substrate samples

The following formulation is used to make up a batch of coating solution.

| Coating | |
|---|---|
| Co-polyester sealant | 10–20% |
| Aroma | 2–10% |
| Solvent | 7–20% |
| Tetrahydrofuran (THF) | 50–75% |

The coating contains a co-polyester sealant that is Amorphous Polyethylene Tetraphlate (APET) based or Ethyl Vinyl Acetate (EVA) based. In this example, the Tetrahydrofuran is a solvent for the sealant.

The solvent for the aroma is MCT oil or Ethanol, the coat weight varying from 1–8 grams of coating solution per square meter of film.

The aromas are Chicken, Beef, Shrimp, Cheese delivered by Flavor Ingredients Specialities S.A.

Samples are coated on a Mylar-based film using an Eleven-Inch Coating Tower.

Example 2

Preparation of aromatized substrate sample

A transparent 2 ml polyester label is cut into circular 3-inch diameter and coated with chicken aroma using a 12 station L6 FLEXO press. Flexographic printing techniques using line screen make it possible to deliver a precise amount of aroma onto the label. The label with or without perforations is prepared. The perforations help to enhance the release of the aroma compounds. The perforations may be made on the top of the label during manufacture or just prior to applying it on to an entrée. The number of perforations and the size on the label is primarily used to further regulate the rate of aroma release during cooking in a microwave oven. The greater the number of perforations the larger is the surface area exposed of the aroma-substrate and, hence, the greater is the rate of aroma release.

FIG. 1 shows an aromatized substrate made according to the above example. The aroma, solvent and sealant are mixed and added as a heat seal coating 1 onto the polyester label 2.

Figure 2:
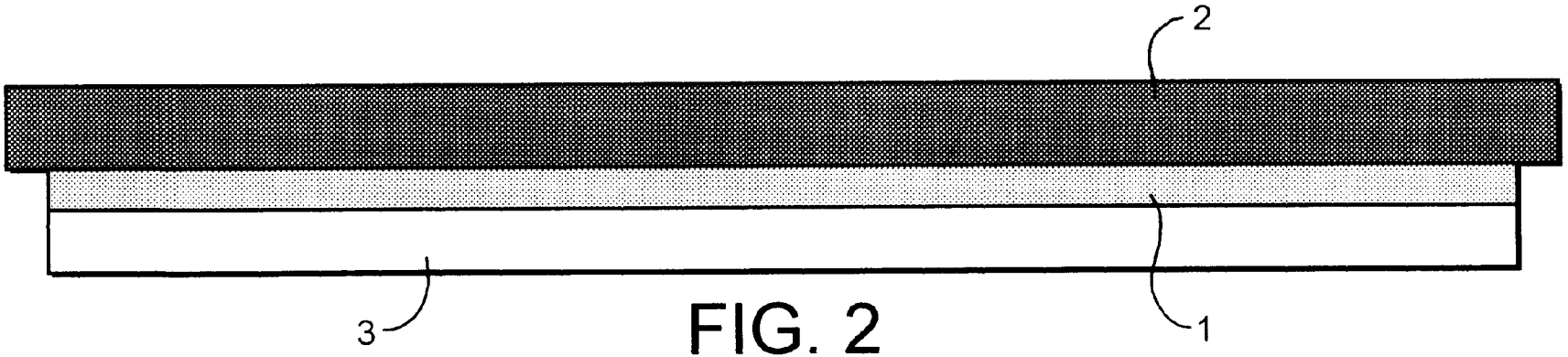
Figure 3:
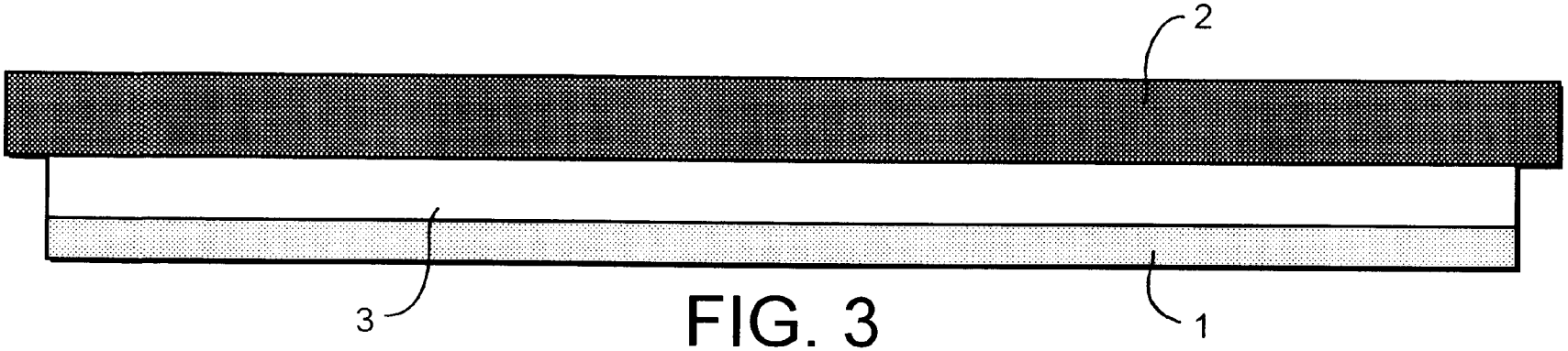
Figure 4:
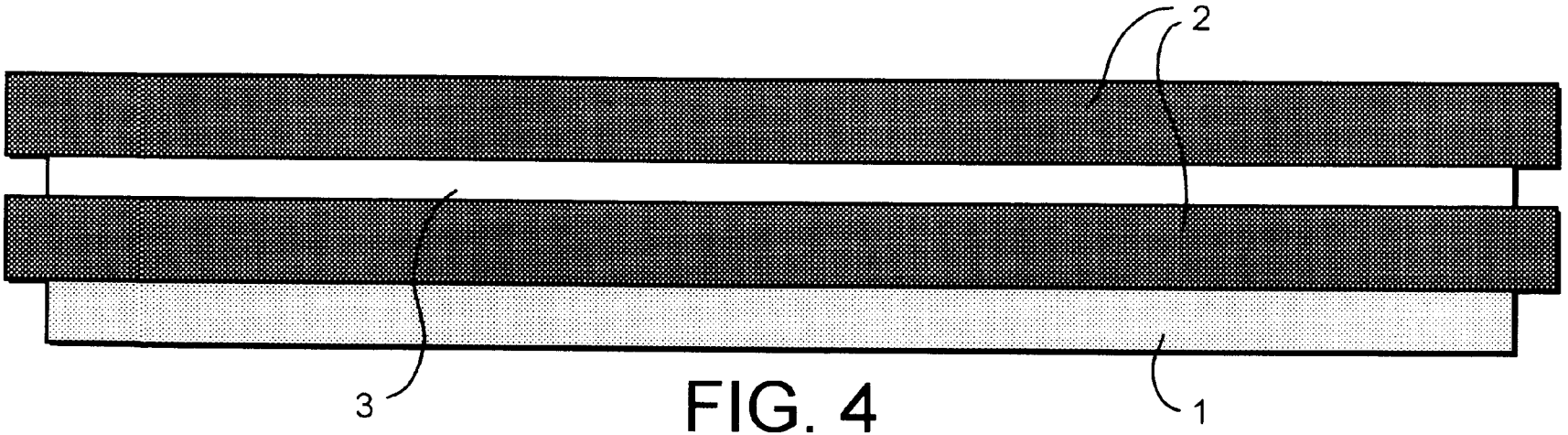

Alternative label combinations are shown in FIGS. 2, 3 and 4. In FIG. 2 the substrate comprises a polyester label 2 and an aroma coating 3 joined by a heat seal coating 1. In FIG. 3 the substrate comprises a polyester label 2 onto which an aroma coating 3 and a heat seal coating 1 is coated. FIG. 4 shows a sandwich approach wherein an aroma coating 3 is sandwiched between polyester labels 2, and a heat seal coating 1 is coated onto one of the polyester labels 2.

Example 3

Heating evaluation of the sample

Samples having coat weights of 40 mg/label or 6.5 gm/m$^2$ lidding stock film Chicken flavor as decried in the Examples 1 and 2 are prepared and tested as follows.

Lidding stock is used to seal the frozen food product (Lean Cuisine Entrées from Nestlé USA Inc.).

The frozen food products used have itself insignificant chicken aroma intensity. Control samples with no flavor added and samples with dried flavor were prepared.

Aromatized labels are placed on the package of ready meals at different places (Lean Cuisine Entrees from Nestlé USA Inc.) and frozen.

Upon re-heating in a 700 Watt microwave at high setting for 5 minutes the packages with aromatized labels release a pleasant roasted chicken aroma as determined by a trained sensory panel.

TABLE 1

GC headspace Study
Level of Hexanal and 2,4 Decadienal
(Aroma marker compound in Chicken flavor)

| SAMPLES | HEXANAL Peak Area | 2,4-DECADIENAL Peak Area |
|---|---|---|
| Control | 1,979 | 7,409 |
| Spray dried Flavor | 24,942 | 9,246 |
| Aromatized label/film | 1,489,017 | 53,809 |

TABLE 2

Sensory Evaluation Study
Chicken Intensity Scores of Frozen Food Entrée after 4 min of microwave heating by a trained sensory panel on an intensity scale.

| SAMPLES | Active aroma per Entrée | Chicken Intensity |
|---|---|---|
| Control | 0.0 mg | 0.00 |
| Spray dried Flavor | 18.02 mg | 3.7 |
| Aromatized label/film | 4.1 mg | 4.5 |

It has been found that for the spray dried flavor added to frozen entrées the amount of active aroma per serving is approximately 4 times more as compared to the aroma in packaging film to achieve similar chicken aroma intensity. Prior to heating the aroma has no flavor impact when applied in the packaging film or on the label. The packages of both types of frozen packed entrées need to be pierced or slightly peeled to provide venting of steam generation from the food during the heating. This steam generation is typically for microwave frozen dishes.

Example 4

Freeze—Thaw Control

Samples, which are prepared, as indicated above are subjected to freeze-thaw cycle to evaluate the storage stability of the aroma.

The samples are subjected to 4-cycle freeze-thawing. The freezing cycle last for 9 hours followed by thawing cycle of 15 hours. The samples are placed in a freezer (−20° C.) and removed after 9 hours. They are then transferred to a refrigerator (4° C.) for 15 hours. This cycle is repeated four times.

An identical set of samples is stored at −20° C. for the same period and used as control set.

Part of the samples is evaluated by sensory analysis to establish loss of flavor, development of new aromas (e.g. rancidity) and loss or increase in intensity. Furthermore, samples are subjected to Head space gas Chromatography.

TABLE 3

Freeze thaw-stability Study
Chicken Intensity Scores of Frozen Food Entrée after 4 min of microwave heating by a trained sensory panel on an intensity scale.

| SAMPLES | Chicken Intensity NO STORAGE | Chicken Intensity FROZEN Storage | Chicken Intensity FREEZE-THAW Storage |
|---|---|---|---|
| Control | 3.7 | 3.00 | 1.79 |
| Test | 4.5 | 4.58 | 4.36 |

The Studies show that the aromatized label is stable to freeze-thaw temperature abuse and frozen storage for extended periods of time.

What is claimed is:

1. A food package having a built-in aroma comprising:

a food compartment and an aromatized substrate comprising a heat sensitive sealant which contains an aroma, wherein the heat sensitive sealant is effective to preserve the aroma during freezing, refrigeration, and ambient storage, and wherein the heat sensitive sealant releases the aroma upon heating to a temperature above ambient temperature when the package with the food in the food compartment is heated in a microwave oven.

2. The food package according to claim 1, wherein the aromatized substrate comprises aroma, an aroma solvent and the heat-sensitive sealant.

3. The food package according to claim 1, wherein the substrate has a flavor load of 15 to 100 ppm of active aroma.

4. The food package according to claim 3, wherein the coat weight of the aromatized substrate is above 6.5 g/m2.

5. The food package according to claim 3, wherein the coat weight of the aromatized substrate is above 7.0 g/m2.

6. The food package according to claim 1, wherein the sealant is one of an amorphous polyethylene tetraphlate (APET), Ethyl Vinyl Acetate (EVA) or an acrylic based pressure sensitive sealant.

7. The food package according to claim 2, wherein the solvent for the aroma is one of MCT oil or ethanol.

8. The food package according to claim 2, wherein the aroma, the aroma solvent and the sealant are coated onto the package.

9. The food package according to claim 8, wherein the package includes a film lid onto which the substrate is coated.

10. The food package according to claim 1, wherein the aroma is releasable at temperatures above ambient and below about 100° C.

11. The food package according to claim 1, wherein the aromatized substrate is attached to an outside face of the package.

12. The food package according to claim 1, wherein the aromatized substrate is incorporated in or on a label which is attached to the package.

13. The food package according to claim 11, wherein the aromatized substrate is printed onto the label utilizing flexographic printing techniques.

14. The food package according to claim 1, wherein the package comprises frozen food.

15. The food package according to claim 1, wherein the aroma is releasable at temperatures between about 40° C. and about 100° C.

16. The food package according to claim 1, wherein the sealant is ethyl vinyl acetate.

17. The food package according to claim 1, wherein the sealant is an acrylic based pressure sensitive sealant.

18. A food package having a built-in aroma comprising a food compartment and an aromatized substrate comprising a heat sensitive sealant which contains an aroma, wherein the heat sensitive sealant is effective to preserve the aroma during freezing, refrigeration, and ambient storage, and wherein the heat sensitive sealant is capable of releasing the aroma upon heating to a temperature above ambient and below about 100° C.

19. The food package of claim 18 wherein the heat sensitive sealant is capable of releasing the aroma upon heating in a microwave oven.

20. The food package of claim 18 wherein the heat sensitive sealant is capable of releasing the aroma upon heating to a temperature above about 40° C.

* * * * *